US005921435A

United States Patent [19]

Billet

[11] Patent Number: 5,921,435

[45] Date of Patent: Jul. 13, 1999

[54] PORTABLE BACKPACK DISPENSER FOR BEVERAGE CONTAINERS

[75] Inventor: Robert L. Billet, North Wales, Pa.

[73] Assignee: Robert Billet Promotions, Inc., Springhouse, Pa.

[21] Appl. No.: 08/842,144

[22] Filed: Apr. 23, 1997

[51] Int. Cl.[6] ..... A45C 15/00

[52] U.S. Cl. ..... 221/185; 224/148.3

[58] Field of Search ..... 221/185, 307, 221/312 C; 224/148.1, 148.4, 148.5, 148.6, 148.7

[56] References Cited

U.S. PATENT DOCUMENTS

| | | | |
|---|---|---|---|
| Re. 16,669 | 7/1927 | Kaye . | |
| Re. 18,291 | 12/1931 | Kaye . | |
| D. 283,758 | 5/1986 | Stewart et al. | D3/77 |
| D. 342,412 | 12/1993 | Ash, Jr. | D7/300 |
| D. 355,297 | 2/1995 | Ash, Jr. | D3/217 |
| 1,109,161 | 9/1914 | Chingren . | |
| 1,566,099 | 12/1925 | Kaye . | |
| 2,704,627 | 3/1955 | Brulin et al. | 226/46.1 |
| 3,114,486 | 12/1963 | Flexman | 224/8 |
| 3,263,806 | 8/1966 | Ring | 206/56 |
| 3,369,723 | 2/1968 | Saari et al. | 224/5 |
| 3,578,199 | 5/1971 | Duncan | 220/31 |
| 4,018,371 | 4/1977 | George | 224/26 |
| 4,199,248 | 4/1980 | Schlapp et al. | 354/286 |
| 4,228,908 | 10/1980 | Tweeton | 215/11 C |
| 4,449,654 | 5/1984 | Cappis | 224/148 |
| 4,673,117 | 6/1987 | Calton | 224/151 |
| 4,754,903 | 7/1988 | Dennis | 224/148 |
| 4,869,402 | 9/1989 | Ash, Jr. | 222/209 |
| 4,941,603 | 7/1990 | Creamer et al. | 224/148 |
| 5,086,948 | 2/1992 | Slusarz | 221/185 |
| 5,095,718 | 3/1992 | Ormond et al. | 62/457.5 |
| 5,165,583 | 11/1992 | Kouwenberg | 224/148 |
| 5,184,762 | 2/1993 | Nevitt | 224/148 |
| 5,199,609 | 4/1993 | Ash, Jr. | 222/94 |
| 5,289,943 | 3/1994 | Powell | 221/67 |
| 5,395,011 | 3/1995 | Kennedy | 221/96 |
| 5,529,220 | 6/1996 | Credle, Jr. et al. | 222/175 |
| 5,611,457 | 3/1997 | Ash, Jr. | 221/185 |

*Primary Examiner*—Janice L. Krizek
*Assistant Examiner*—Gregory A Morse
*Attorney, Agent, or Firm*—Caesar, Rivise, Bernstein, Cohen & Pokotilow, Ltd.

[57] ABSTRACT

A portable dispenser for beverage containers for use by a vendor. The dispenser comprises a strap assembly and is arranged to be worn like a backpack and includes a housing and a chamber located within the housing. A rack, disposed within the chamber, comprises at least one dispensing chute. The dispensing chute comprises a receiving end to permit the insertion of a plurality of beverage containers therein, an intermediate length for retaining the beverage containers in the chute in single-file relationship and an outlet end. The dispensing chute is arranged to present a successive beverage container to the outlet end upon the removal of a preceding beverage container from the outlet end. The dispenser additionally comprises at least one dispensing port located adjacent the rack. The dispensing port is in communication with the outlet end of the dispensing chute to enable the vendor to remove beverage containers from the dispenser.

26 Claims, 18 Drawing Sheets

PORTABLE BACKPACK DISPENSER FOR BEVERAGE CONTAINERS

TO ALL WHOM IT MAY CONCERN

Be it known that I, Robert L. Billet, a citizen of the United States of America, residing in North Wales, County of Montgomery, Commonwealth of Pennsylvania have made a certain new and useful invention in a Portable Backpack Dispenser for Beverage Containers of which the following is a specification.

BACKGROUND OF THE INVENTION

This invention relates generally to a portable backpack dispenser for beverage containers and more particularly to a portable backpack dispenser for bottles and cans, that provides a plurality of receiving openings and dispensing ports to enable dispensing from a plurality of delivery paths within the chamber.

It is quite common at athletic events and other events which draw large crowds for vendors selling or dispensing hot and cold beverages to circulate among the people.

There also have been numerous suggestions in the prior art of providing devices for dispensing cans or bottles containing liquid beverages such as soft drinks. Representative devices for carrying and/or dispensing beverage containers such as bottles and cans are disclosed in U.S. Pat. No. 1,566,099 (Kaye); U.S. Pat. No. Re 18,291 (Kaye); U.S. Pat. No. Re 16,669 (Kaye); U.S. Pat. No. 2,704,627 (Brulin et al.); U.S. Pat. No. 5,095,718 (Ormond et al.); U.S. Pat. No. 4,673,117 (Calton); U.S. Pat. No. 3,263,806 (Ring); U.S. Pat. No. 4,754,903 (Dennis); U.S. Pat. No. 4,018,371 (George); and, U.S. Pat. No. 4,449,654 (Cappis). Some of the dispensers disclosed in these patents are portable and some are even arranged to be worn as a backpack.

While all of the aforementioned patents seem suitable for their intended purposes, it would be a significant advance in the art to provide a dispenser for beverage containers that is arranged to be worn like a backpack and is particularly effective at permitting hands free operation during vending and enabling use without the necessity for removing the dispenser from the vendor's back during vending.

OBJECTS OF THE INVENTION

Accordingly, it is a general object of this invention to provide a beverage container dispenser which overcomes the disadvantages of the prior art.

It is a further object of this invention to provide a dispenser for beverage containers that is inexpensive to manufacture.

It is a further object of this invention to provide a dispenser for beverage containers that is reliable in operation.

It is a further object of this invention to provide a dispenser for beverage containers that is simple in construction.

It is a further object of this invention to provide a dispenser for beverage containers that is portable and can be worn on the back of a vendor to provide the vendor with hands free operation.

It is a further object of this invention to provide a dispenser for beverage containers which is constructed to enable vending of both cans and bottles simultaneously and wherein the cans may be filled with different types of beverages.

It is a further object of this invention to provide a dispenser for beverage containers which enables stacking of beverage containers in a uniform side-by-side relationship that minimizes the possibility of jamming of cans and bottles during dispensing.

It is a further object of this invention to provide a dispenser for beverage containers which is constructed to enable simultaneous vending of beverage containers filled with different types of beverages.

SUMMARY OF THE INVENTION

These and other objects of this invention are achieved by providing a portable dispenser for beverage containers for use by a vendor. The dispenser comprises a strap assembly and is arranged to be worn like a backpack to enable hands free use during vending. The dispenser comprises a container and a chamber located within the container. A rack, disposed within the chamber, comprises at least one dispensing chute. The dispensing chute includes a receiving end to permit the insertion of a plurality of beverage containers therein, an intermediate length for retaining the beverage containers in the chute and an outlet end. The dispensing chute is arranged to present a successive beverage container to the outlet end upon the removal of a preceding beverage container from the outlet end. The dispenser additionally comprises at least one dispensing port located adjacent the rack means. The dispensing port is in communication with the outlet end of the dispensing chute to enable the vendor to remove beverage containers from the dispenser.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
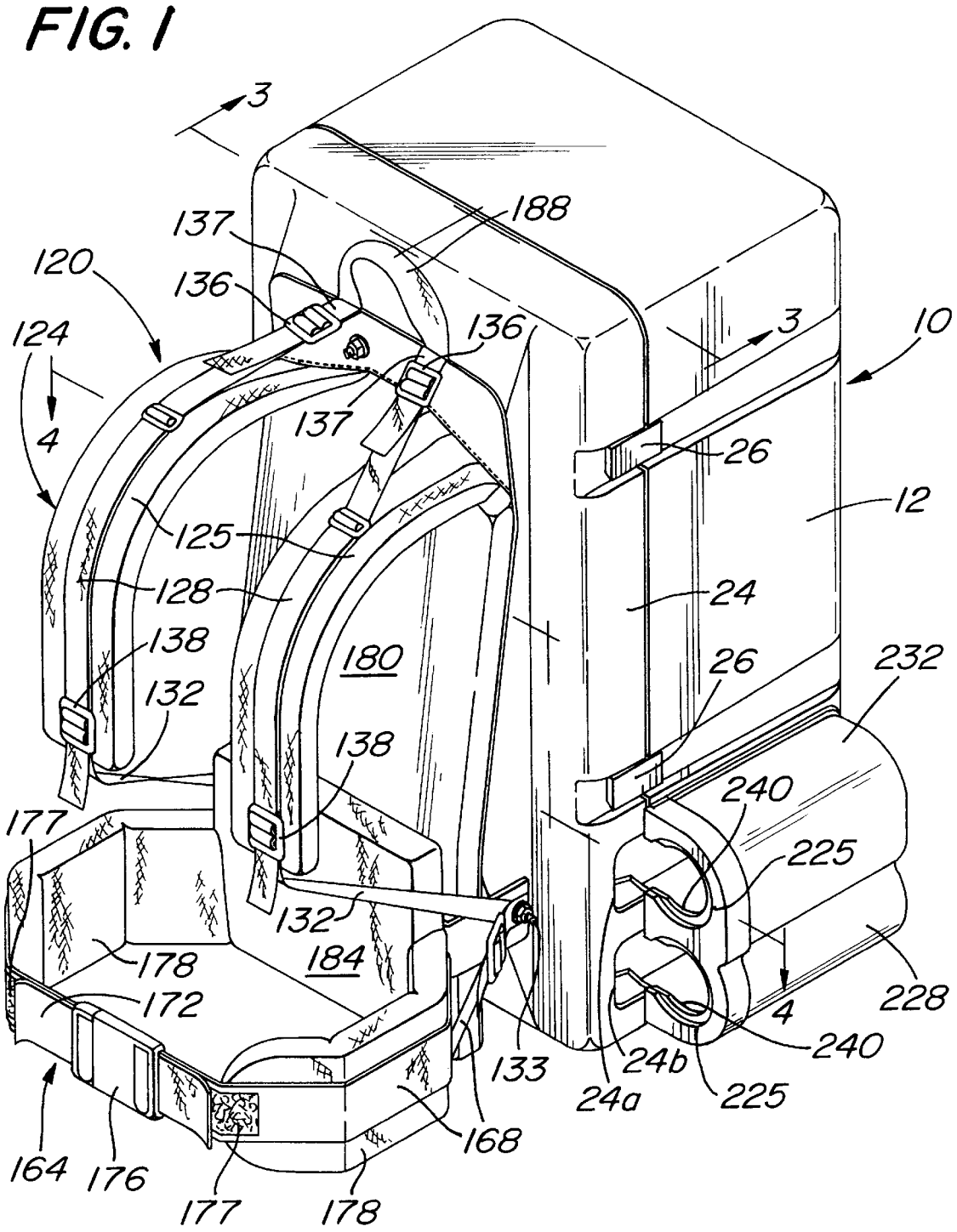
FIG. 1 is an isometric view of a first embodiment of the portable dispenser of the present invention.
Figure 2:
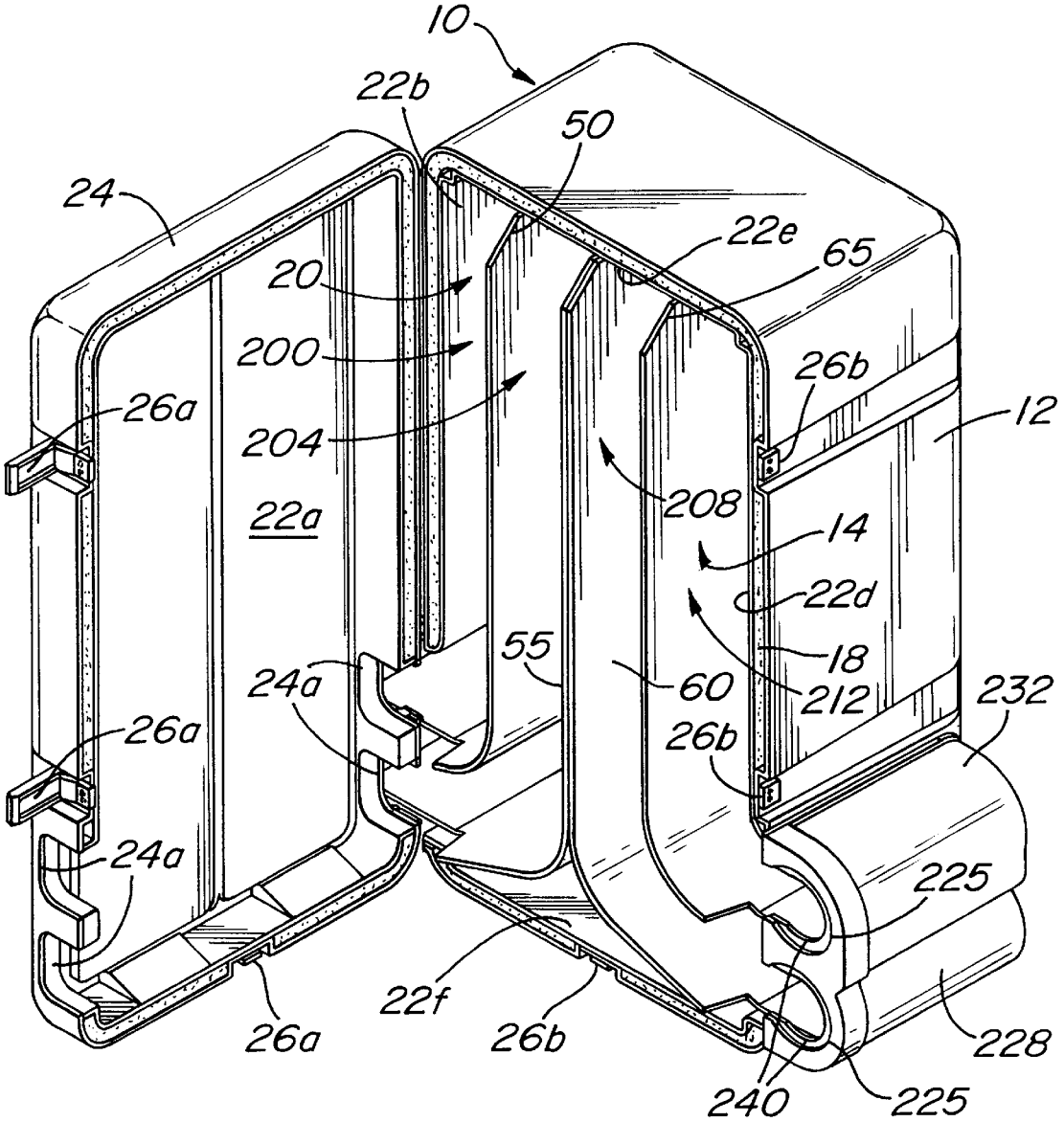
FIG. 2 is an isometric view of a first embodiment of the portable dispenser shown in FIG. 1 with the door of the housing placed in the open position.

Referring now in greater detail to the various figures of the drawings wherein like reference numerals refer to like parts there is shown at 10 in FIGS. 1 and 2, a preferred embodiment of the dispenser constructed in accordance with this invention.

Figure 5:
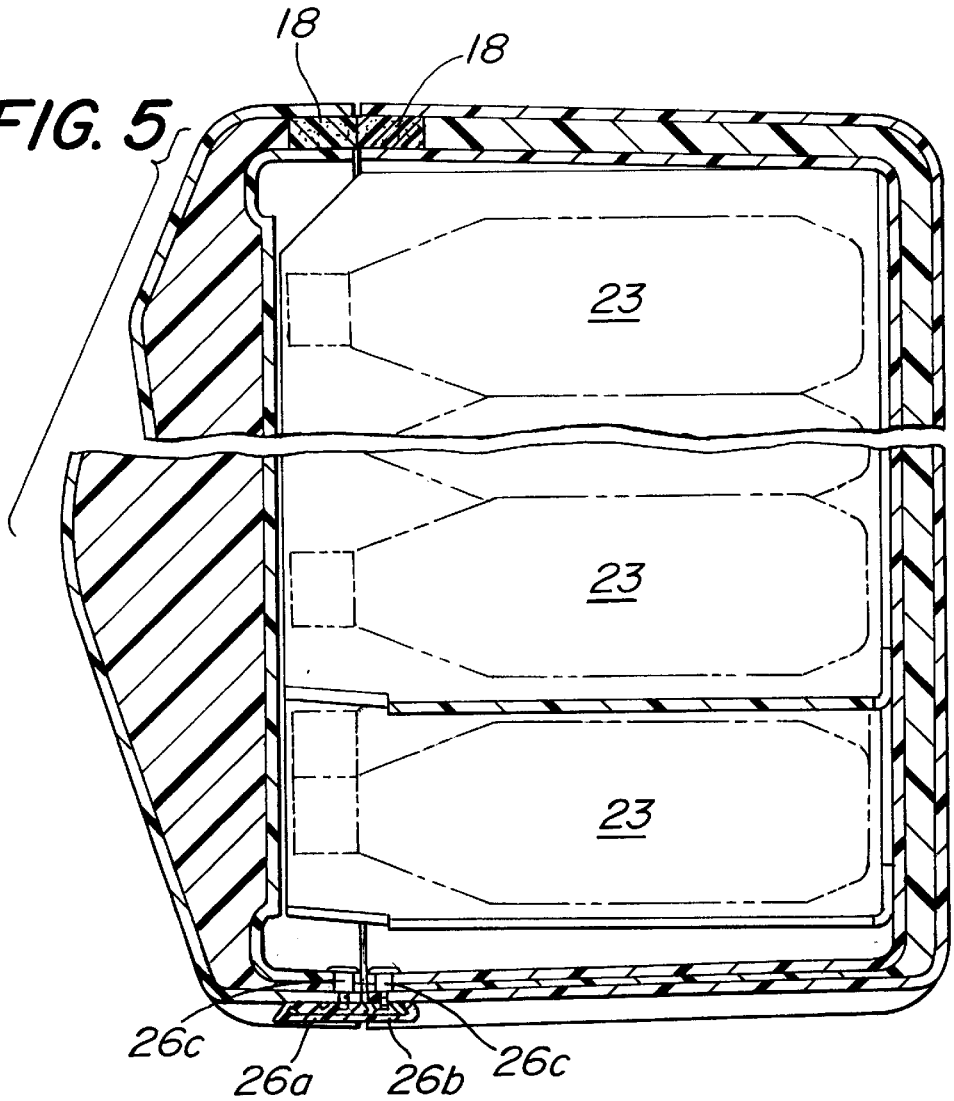
FIG. 5 is a sectional view taken along line 5—5 of FIG. 3.

The dispenser is provided with a strap assembly 120 for supporting the dispenser 10 on the back of a vendor. The dispenser is arranged for dispensing a variety of differently sized and shaped beverage containers, e.g., cans or bottles, containing both carbonated and noncarbonated beverages such as soda, beer, ice tea, chocolate milk, etc. The details of the portable beverage container dispenser will be described later. Suffice it for now to say that the preferred embodiment of the dispenser basically comprises a housing formed of a storage portion 12 and a door portion 24 pivotally mounted to the storage portion 12 by hinges (not shown) to enable the door to swing between an open position to enable the vendor to load the rack assembly 20 located therein with beverage containers and a closed position during vending. The door 24 is held in place in the closed position by means of clasps 26 each comprising cooperating clasping components 26*a* and 26*b*, as best shown in FIG. 5. The clasp components 26*a* and 26*b* are affixed to the door portion 24 and storage portion 12, respectively, using suitable hardware, e.g., rivets 26*c* (FIG. 5).

Figure 3:
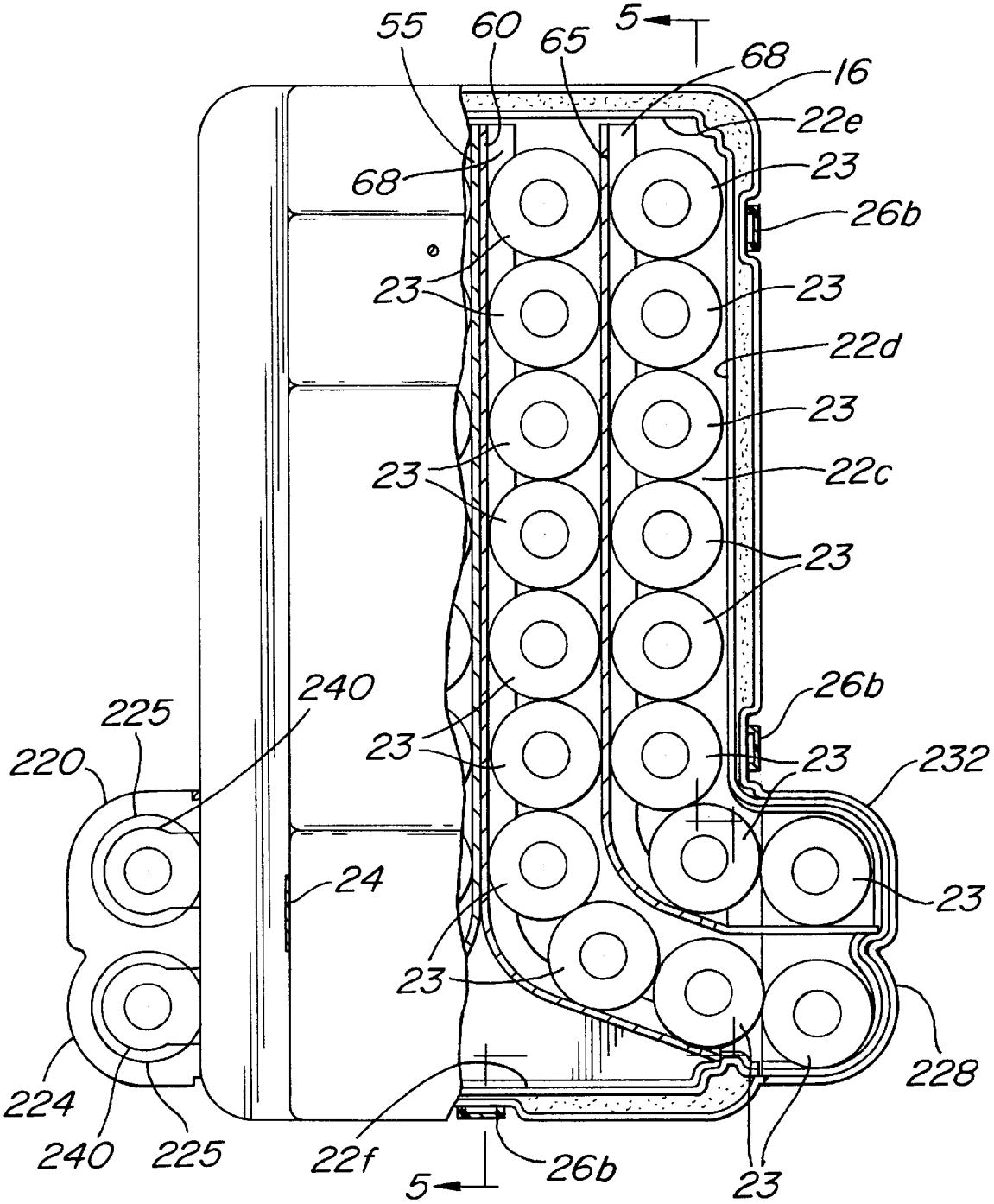
FIG. 3 is a sectional view taken along line 3—3 of FIG. 1.
Figure 4:
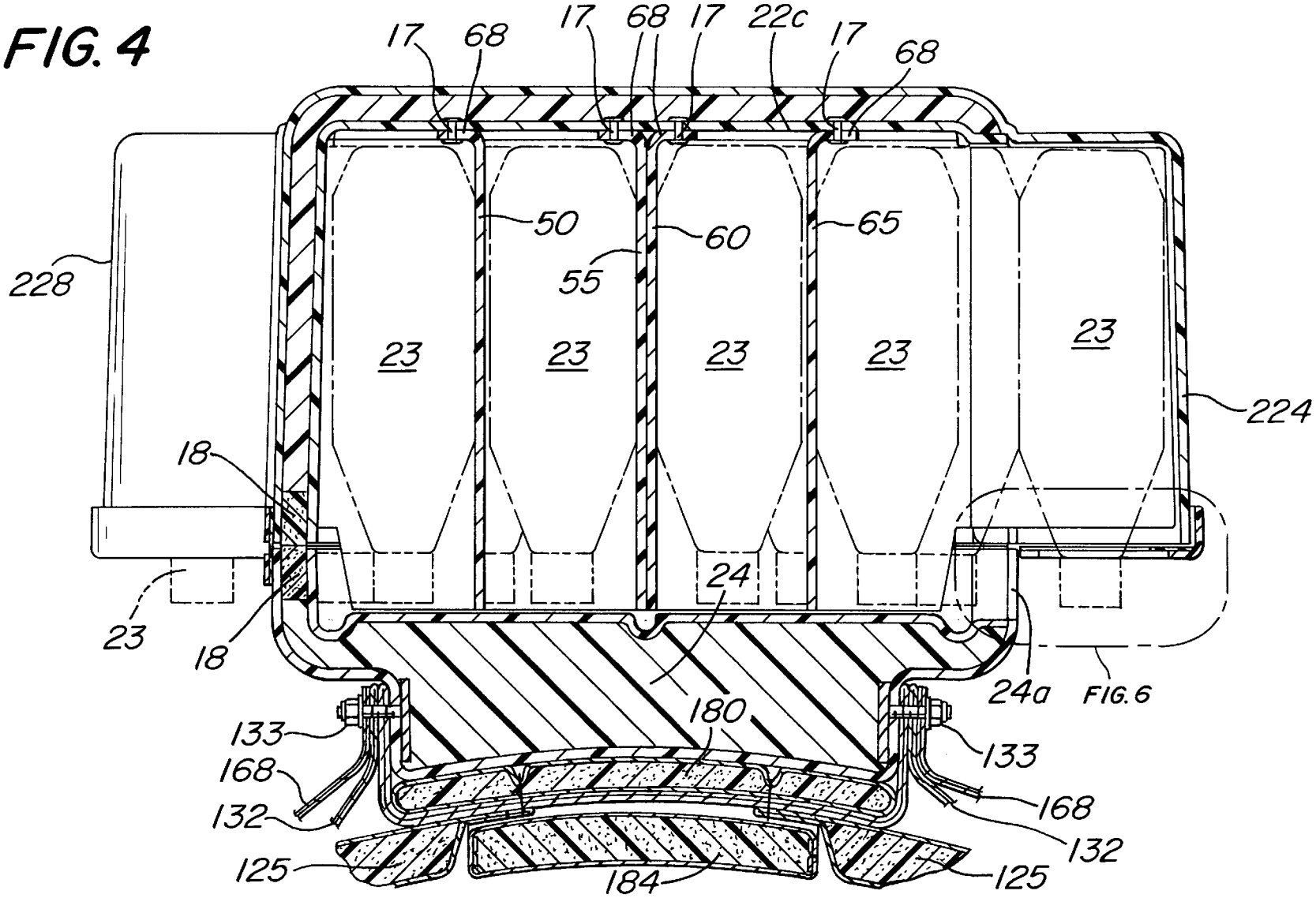
FIG. 4 is a sectional view taken along line 4—4 of FIG. 1.

Referring now to FIG. 2, when the door portion 24 is in the closed position, an internal compartment 14 is formed within the dispenser 10. As best shown in FIG. 4, when the door portion 24 is in the closed position, the internal compartment is of a predetermined depth that is suitable for accommodating beverage containers 23, e.g., bottles, stacked in side-by-side relationship. Referring now to FIGS. 2 and 3, a rack assembly 20 is disposed within the internal compartment 14. The rack assembly 20 comprises a plurality of dispensing chutes, 200, 204, 208 and 212. Each dispensing chute is arranged to receive a plurality of beverage containers 23 therein, retain the beverage containers in a side-by side, single-file relationship and present them successively to one of a plurality dispensing ports located at the lower end of the storage portion 12 to enable removal of the beverage containers by the vendor wearing the dispenser 10. The dispensing ports will be described in detail later in this application.

Because the dispenser 10 of the present invention is provided with a plurality of chutes, it enables the vendor to vend a variety of different beverages simultaneously. That is, the vendor can load a first chute with cans containing one type of beverage, e.g., soda, load a second chute with bottles containing another type of beverage, e.g., ice tea, and load a third chute with cans containing a third type of beverage and a fourth chute with bottles containing a fourth type of beverage. In this manner, rather than being able to offer just one type of beverage to a potential customer, the dispenser of the present invention enables the vendor to offer a variety of beverage options, e.g., four, to choose from thus increasing the potential for sales and profits.

Referring specifically to FIGS. 2, 3 and 4, the storage portion 12 and door portion 24 are each formed of a 2-ply, insulated peripheral wall construction which includes a hard plastic outer wall 16, a foam insulating intermediate core 18 and an inner wall 22*a* through 22*f*. The outer and inner walls may be formed of any suitable plastic material, e.g., ABS or KYDEX.

Referring now to FIGS. 2 and 3, the internal chamber 14 is defined by the inner wall 22*a* (FIG. 2), the sidewalls 22*b* and 22*d* of the storage portion 12 (FIG. 2), the backwall 22*c* of the storage portion 12 (FIG. 3) and the ceiling 22*e* and floor 22*f* of the storage portion 12 (FIG. 2). Because the storage portion 12 and the door portion 24 are constructed of a 2-ply insulated wall construction, the chamber 14 is thermally insulated for the purpose of maintaining the chilled temperature of beverage containers 23 stored within the dispenser 10.

It should be pointed out at this juncture that although FIGS. 3 through 6 show only bottles 23 disposed within the dispenser 10, it should be understood that in accordance with this invention, the dispenser 10 is equally suited for the dispensing of cans.

The rack assembly 20 is housed within the internal chamber 14 of the device 10. In the embodiment shown in FIGS. 1 through 6, the rack assembly is integral with the storage portion 12. In another embodiment, to be described in detail later in this application, the rack assembly is removable from the storage portion to facilitate the loading of beverage containers into the rack assembly.

Returning now to the preferred embodiment, and referring specifically to FIGS. 2–4, the rack assembly 20 is comprised of a plurality of chutes 200, 204, 208 and 212, respectively. In particular, chute 200 occupies a space between sidewall 22*b* and divider 50, chute 204 occupies a space between dividers 50 and 55, chute 208 occupies a space between dividers 60 and 65, and chute 212 occupies a space between divider 65 and sidewall 22*d*. Each chute is suitably sized to allow the free movement of beverage containers, e.g., bottles or cans, stacked therein. As best shown in FIG. 4, dividers 50, 55, 60 and 65 are each provided with a rear flange 68 to enable attachment of each divider to the backwall 22*c* of the storage portion 12 by means of conventional hardware, e.g., rivets 17.

As best shown in FIG. 2, when the door portion 24 is placed in the open position, each chute 200, 204, 208 and 212 is arranged to receive beverage containers 23 therein. To load the dispenser 10, the clasping components 26*a* and 26*b* are unlocked and the door portion 24 is placed in the open position. The vendor may stack multiple beverage containers 23 through the open front end of each chute in side-by-side, single-file relationship on top of one another in the arrangement shown in FIG. 3. Stacking in this manner promotes uniformity and lessens the possibility of jamming of cans or bottles during dispensing. Once the dispenser is loaded, the door may be closed and secured in the closed position to provide an airtight seal by means of locking the clasping components 26*a* and 26*b*.

As can be readily appreciated from the foregoing drawings, the chutes are arranged to enable the vendor to load a variety of different beverage containers for simultaneous vending. That is, the vendor can load a first chute 200 with cans containing one type of beverage, e.g., soda, load a second chute 204 with bottles containing another type of beverage, e.g., ice tea, and load a third chute 208 with cans containing a third type of beverage and a fourth chute 212 with bottles containing a fourth type of beverage. In this manner, rather than being able to offer just one type of beverage, the dispenser of the present invention enables the vendor to offer potential customers a variety of beverage options, e.g., four, to choose from thus increasing the potential for sales and profits.

Each chute comprises an upper portion that extends downwardly from the ceiling 22*e* of the storage portion 12 until it reaches an inclined ramp portion. The ramp portion of each chute is provided to direct beverage containers 23 stacked within each chute towards an outlet end located at the bottom of each chute. The outlet end of each chute communicates with one of a plurality of dispensing ports, 220, 224, 228 and 232, each of which forms a portion of the storage portion 12. As best shown in FIGS. 2 and 3, chute 208 ramps towards and is in communication with dispensing port 228. Chute 212 ramps towards and is in communication with dispensing port 232. Likewise, chute 200 ramps towards and is in communication with dispensing port 220 and chute 204 ramps towards and is in communication with dispensing port 224. Referring again to FIG. 3, dispensing ports 220 and 224 are adjacent one side of the storage portion 12, the former located above the latter, while dispensing ports 232 and 228 are adjacent the opposite side of the storage portion 12, the former located above the latter.

As best shown in FIGS. 1 and 2, the door portion 24 is provided with cutout sections 24*a* that correspond with the outlet end of each chute. The cutout sections 24*a* are provided to enable passage of bottles 23 from the outlet end of each chute to the corresponding dispensing port.

Each dispensing port 220, 224, 228 and 232 is provided with a circular opening 225 on its front face that is slightly larger than the exterior dimensions of the beverage container 23 disposed therein. The circular opening 225 is provided to permit the passage of beverage containers 23 therethrough, one at a time, during vending. Each dispensing port is provided with a neoprene cap 240 disposed over the circular opening 225. Each neoprene cap has a circular opening sized slightly smaller than the outer dimension of the beverage container 23.

Figure 6:
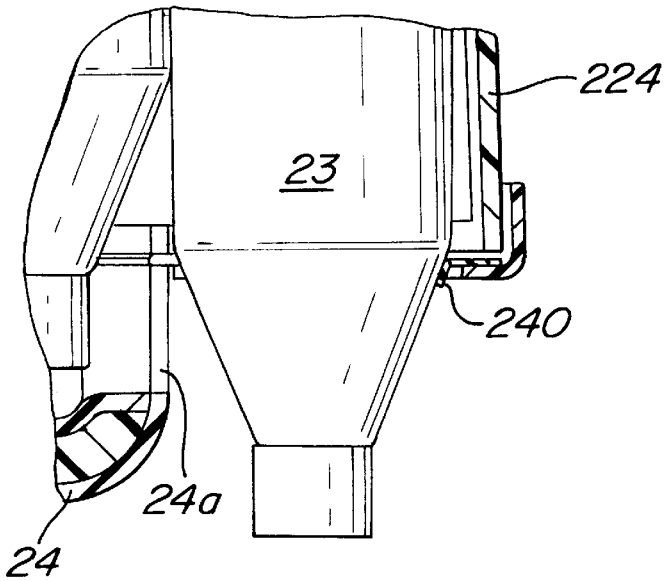
FIG. 6 is an enlarged partial cross-section of an area shown in FIG. 4 that is encircled by a line labelled FIG. 6.

As best shown in FIG. 4, the depth of each dispensing port is actually shorter than the length of a bottle contained therein. In this manner, as best shown in FIG. 6, the dispensing port is sized to permit the neck and cap of a bottle 23 to protrude beyond the port opening 225 so that the neck engages the inner surface of the neoprene cap 240. This engagement acts to restrict the entry of warm air into the interior chamber 14 during vending.

To dispense bottles while the vendor is wearing the dispenser 10 on his back, the vendor reaches back and places his hand adjacent the opening of any one of the dispensing ports and grasps the bottle disposed therein by the neck and withdraws it from the dispensing port. Where cans are being dispensed, it is necessary for the vendor to place his hand into the circular opening 225 to withdraw a can from the dispensing port. As can be appreciated, each dispensing port enables dispensing of beverage containers 23 one at a time. Dispensing ports 220 and 224 are conveniently located at the lower extreme of one side of the storage portion 12 while dispensing ports 228 and 232 are conveniently located at the lower extreme of the other side of the storage portion 12 to provide ready access for both hands when the dispenser 10 is worn on the vendor's back. Also, since the dispenser 10 is worn on the vendor's back rather than being carried by hand, it allows the vendor to keep both hands free during vending for handling containers and money. Moreover, under this arrangement, the vendor is able to vend beverage containers from the dispenser without the assistance of a third-party. When a beverage container 23 is removed from the dispensing port, by operation of gravity, the remaining beverage containers will roll down the ramp portion of the chute to fill the space created by the removed container. The lowermost remaining beverage container 23 will lodge within the dispensing port ready for removal. It is apparent that as lower beverage containers 23 are removed from a dispensing port, beverage containers remaining in the chute will successively move into the dispensing port for removal. The dispensing ports also act to restrain the downward movement of beverage containers 23 within each respective chute.

The dispenser 10 is worn like a backpack. Referring specifically to FIGS. 1 and 4, the strap assembly 120 includes a pair of shoulder straps 124, each of which is provided by upper and lower strap segments 128, 132, respectively, adjustably interconnected through upper and lower buckles 136 and 138, respectively. Specifically, each upper buckle 136 is retained within secured loops 137 which are fixedly secured to the upper rear portion of the storage portion 12. The upper strap segments 128 are adjustably secured to the upper buckle 136 to permit proper adjustment of the shoulder straps 124 about the shoulders and upper chest region of the vendor. The upper strap segments 128 are attached, e.g., sewn, to thickened shoulder pads 125 to provide a level of comfort to the vendor while wearing the dispenser loaded with filled beverage.

The lower buckles 138 are retained within a secured loop sewn at the lower end of each upper strap segment 128. At one end, the lower strap segment 132 is adjustably secured to the upper buckle 136 to also permit proper adjustment about the vendors shoulders and upper chest region. At its other end, the lower strap segment 132 is fixedly secured to the storage portion 12 by means of mounting hardware 133.

Still referring to FIGS. 1 and 4, the strap assembly 120 is completed by a waist strap 164 formed by a pair of waist strap segments 168 and 172, each of which is adjustably connected to a buckle 176. The buckle 176 is preferably of the bayonet-type construction providing for the quick connect and disconnect thereof. Mounted to the outer surface of waist straps segments 168 and 172 are cooperating VELCRO (trademark) components 177 to provide for a snug fit of the waist strap 164 around the waist of the vendor. The waist strap segments 168 and 172 are attached, e.g., sewn, to thickened waist pads 178 to provide additional comfort to the vendor while wearing the dispenser.

Each of the straps forming the strap assembly 120 is composed of high-strength fibers of plastic or other type material, such as nylon or polyester, which are woven together or otherwise interlaced to form a single ply or multiple ply web.

The strap assembly 120 is provided with additional padded surfaces 180 and 184, respectively, that correspond with the upper and lower sections of the vendor's back. The strap assembly 120 is also provided with a strap that forms a handle 188 to provide easy carrying of the dispenser when not positioned on the vendor's back.

Figure 7:
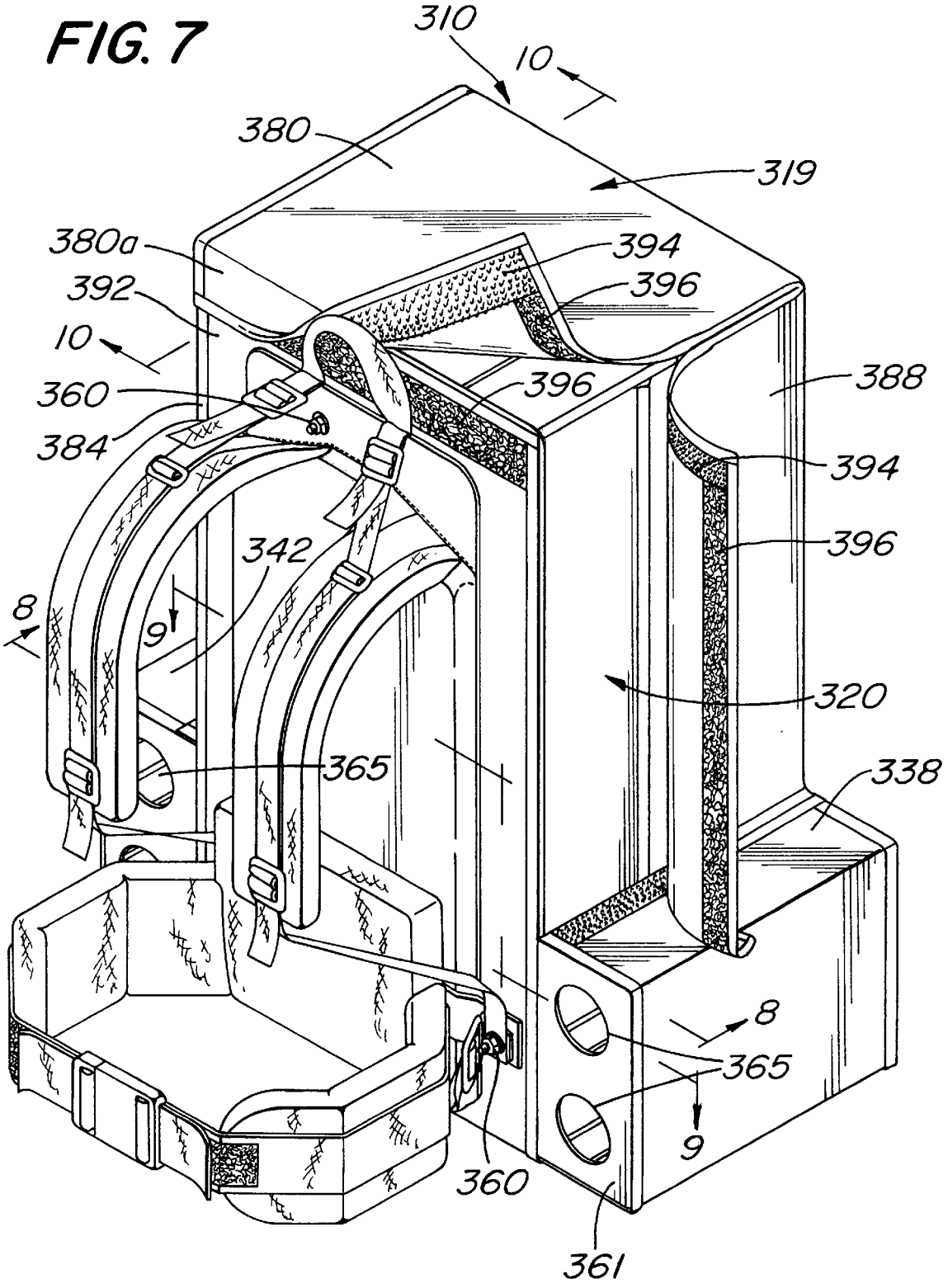
FIG. 7 is an isometric view of a second embodiment of the dispenser of the present invention.
Figure 8:
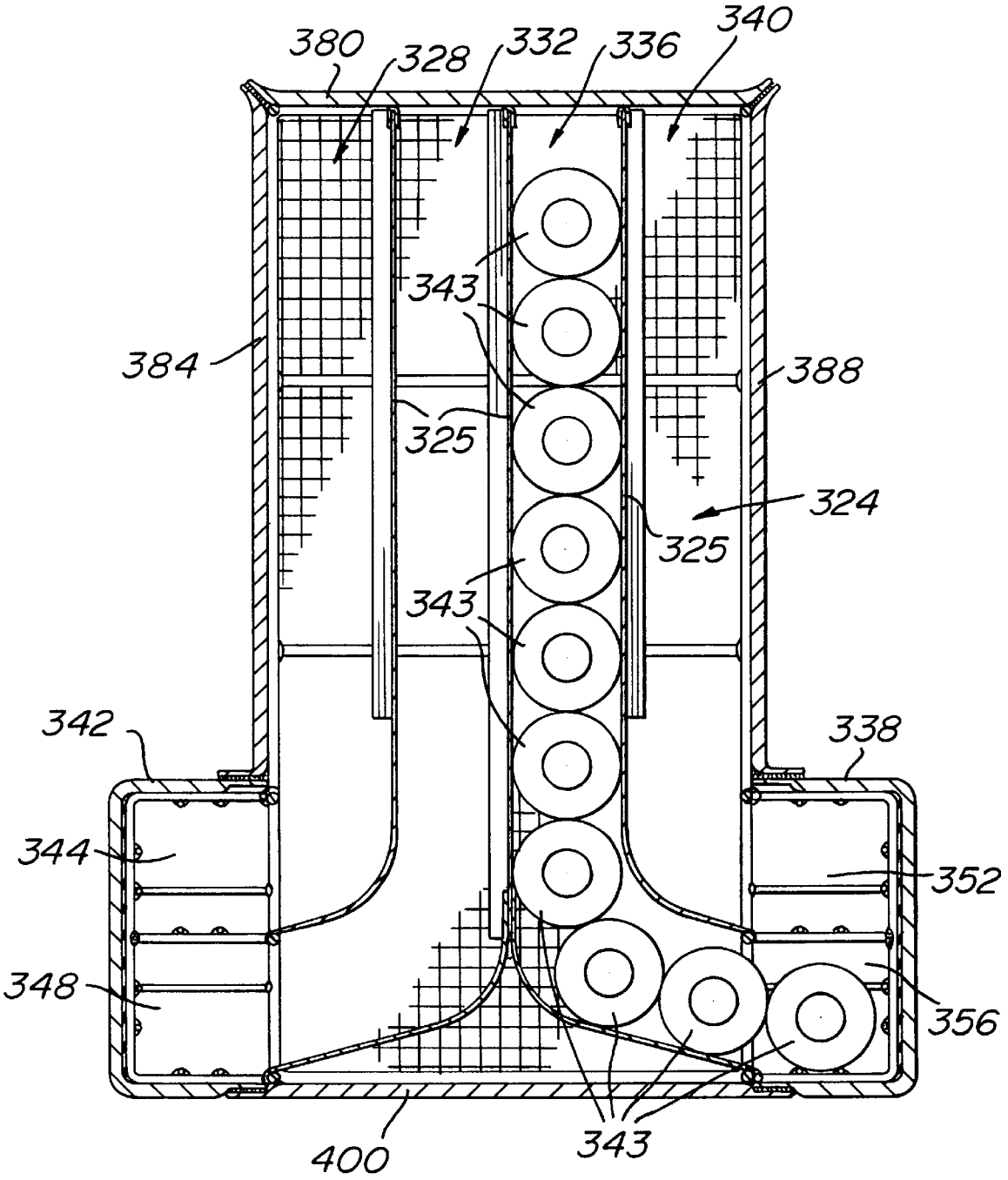
FIG. 8 is a sectional view taken along line 8—8 of FIG. 7.

Referring now to FIG. 7, there is shown at 310 a second embodiment of dispenser constructed in accordance with this invention. Basically, the second embodiment 310 comprises an insulate d fabric cover 319 that surrounds a rack assembly 320. As best shown in FIG. 8, the rack assembly 320 comprises an enclosed rectangular box-shaped rack assembly 324 that is divided by dividers 325 to form a plurality, e.g., four, dispensing chutes 328, 332, 336 and 340. The rack assembly 324 is a lattice framework formed of any suitable material, e.g., stainless steel or aluminum, and is constructed in a manner to permit insertion of beverage containers 343 only through openings located at the top of each chute.

Figure 9:
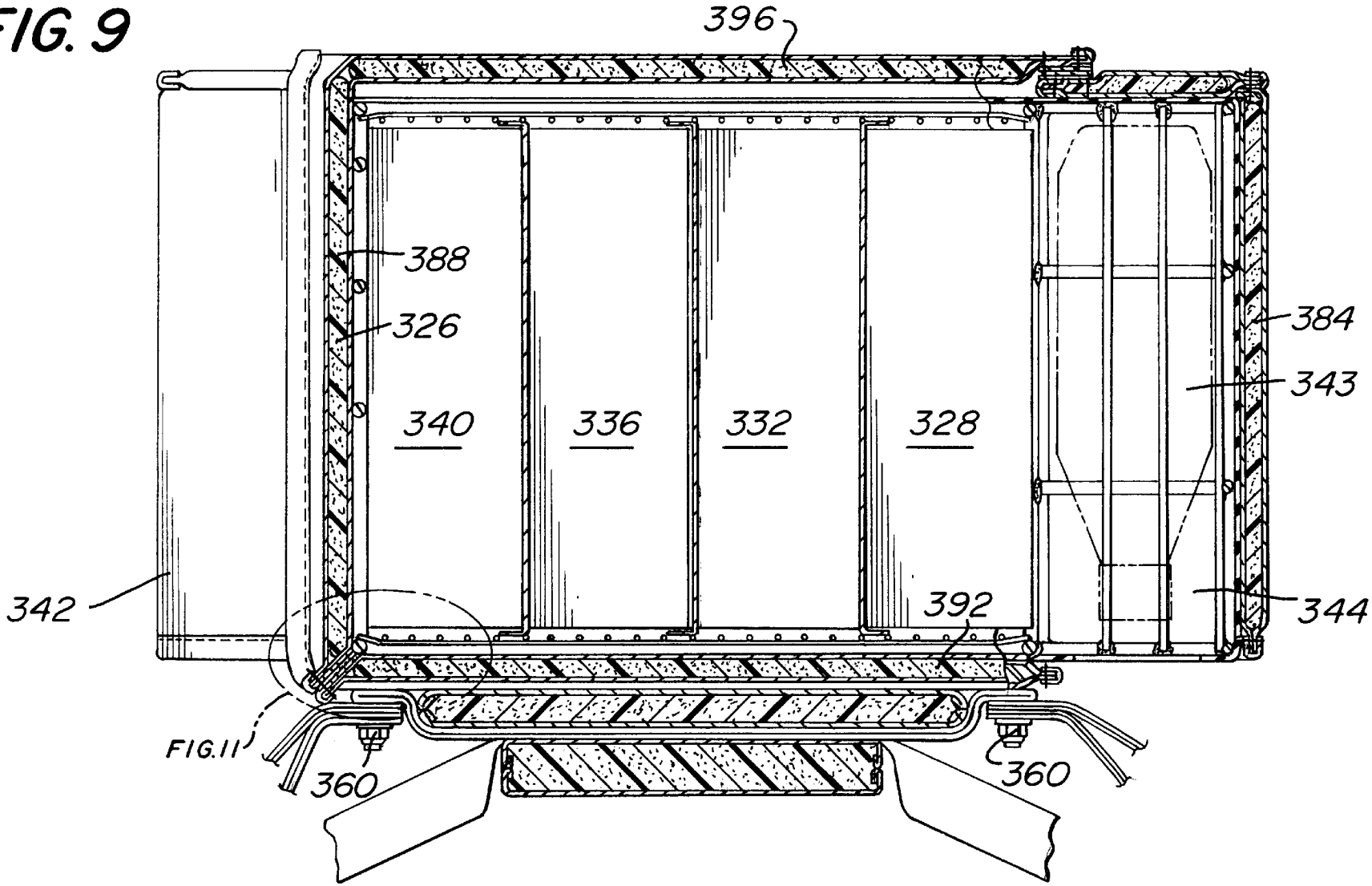
FIG. 9 is a sectional view taken along line 9—9 of FIG. 7.

As best shown in FIG. 8, each dispensing chute is arranged to receive a plurality of beverage containers 343 therein, retain the beverage containers in a side-by-side, single-file relationship and present them successively to one of a plurality of dispensing ports 344, 348, 352 and 356. Stacking in this manner promotes uniformity and lessens the possibility of jamming of cans and bottles during dispensing. As best shown in FIGS. 8 and 9, the dispensing port a re each a cage-like structure formed of any suitable material, e.g., steel or aluminum. Referring again to FIG. 8, dispensing ports 344 and 348 are adjacent one side of the rack assembly 324, the former located above the latter, while dispensing ports 352 and 356 are adjacent the opposite side of the rack assembly 324, the former located above the latter. Each dispensing port is constructed in a manner to permit withdrawal of beverage containers 343 only through the front end thereof during vending. As best shown in FIG. 8, chute 328 ramps towards and is in communication with dispensing port 344, chute 332 ramps towards and is in communication with dispensing port 348, chute 336 ramps towards and is in communication with dispensing port 356 and chute 340 ramps towards and is in communication with dispensing port 352.

A neoprene liner 361, located under the insulated fabric cover 319 surrounds the dispensing ports 344, 348, 352 and 356 and the lower portion of the main rack assembly 324. The neoprene liner 361 comprises a plurality of circular openings 365, each centered over the open end of each dispensing port. Each circular opening 365 is slightly larger than the exterior dimensions of the beverage container to permit the passage of beverage containers 343 therethrough one at a time during vending. The neoprene liner 361 also acts to restrict the entry of warm air into the dispensing ports and the compartment during vending.

This embodiment also comprises a strap assembly similar in construction to that described in connection with the first embodiment. As best shown in FIGS. 7 and 9 the strap assembly 321 is removably secured to the rack assembly 320 by means of conventional hardware 360, e.g., nuts and bolts.

Figure 10:
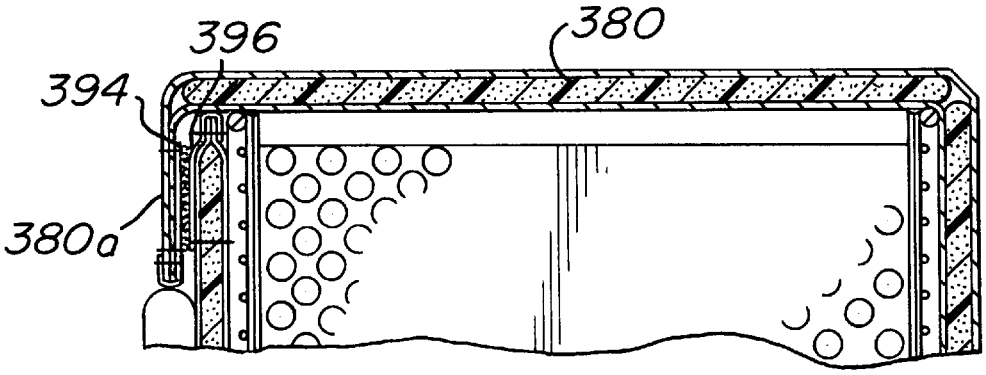
FIG. 10 is a sectional view taken along line 10—10 of FIG. 7.

Referring again to FIG. 7, the insulated fabric cover 319 attaches to the rack assembly by means of conventional hardware, e.g., nuts, bolts and washers. The fabric cover 319 comprises an outer jacket portion and an insulating material enclosed therein. The jacket and insulation portions may be formed of any suitable material. One particularly effective jacket material is 600 denier ballistic nylon. One particularly effective insulating material is a neoprene foam insert that may be inserted within the jacket portion of the cover 319. Referring now to FIGS. 7, 8 and 9, the insulation includes a top panel 380, side panels 384 and 388, a front panel 392, a rear panel 396 and a bottom panel 400. The cover also includes panels 338 and 342 that cover the dispensing ports. As best shown in FIGS. 7 and 10, the top panel 380 is provided with a front flap 380a that folds over front panel 392 of the fabric cover. The front flap 380a includes on its underside, the hook component 394 of a VELCRO (trademark) fastening system. The cooperating loop component 395 is secured, e.g., sewn, to the top edge of the front panel 392 so that the top panel 380 of the fabric cover 319 can be held tightly against the front panel 392 to ensure that the rack assembly 320 is properly held within the fabric cover 319.

Figure 11:
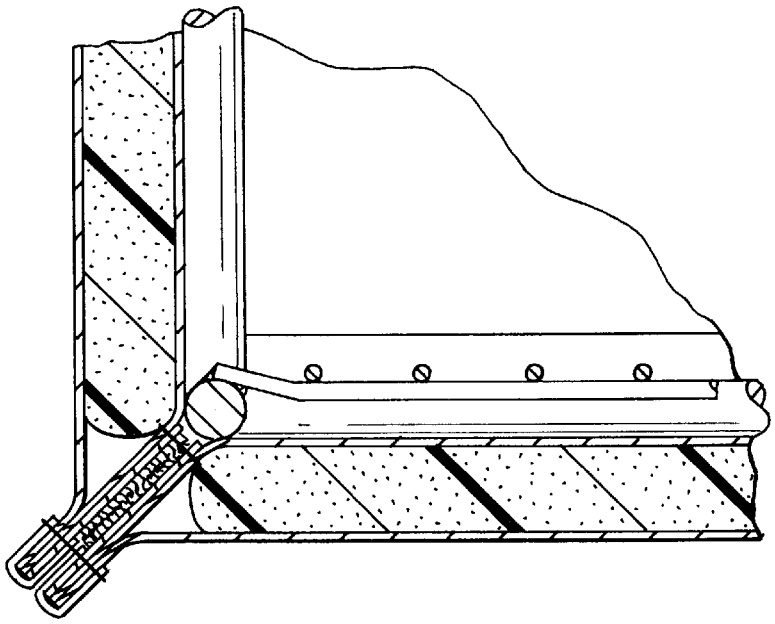
FIG. 11 is an enlarged partial cross-section of an area shown in FIG. 9 that is encircled by a line labelled FIG. 11.
Figure 12:
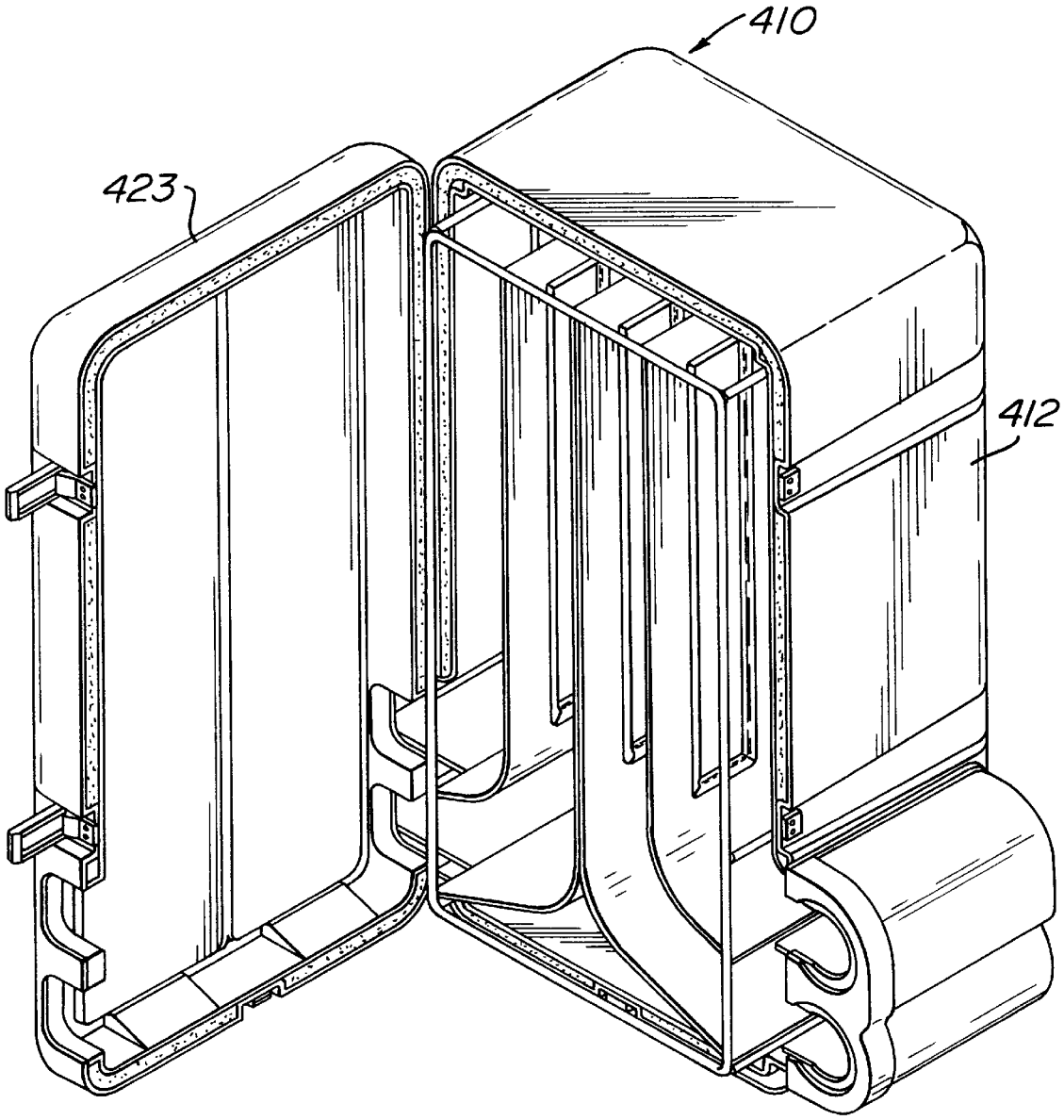
FIG. 12 is an isometric view of the preferred embodiment of the portable dispenser of the present invention.

The top panel 380 also includes loop components 395 secured along its remaining free edges that cooperate with hook components 394 secured along the top edges of the side panels 384. FIGS. 8 and 11 illustrate the top panel 380 and the side panels 384 and 388 of the fabric cover 319 joined together along these edges. FIG. 8 also demonstrates that each fabric cover section 338 and 342 covering the dispensing ports includes a hook component 394 that cooperates with a loop component 395 secured along the bottom edge of each side panel 388.

For loading this embodiment of the container dispenser 310 with previously chilled beverage containers 343, e.g., bottles and/or cans, the vendor simply removes the top panel 380 by peeling back the front flap 380*a* from the front panel 392 to gain access to dispensing chutes 328, 332, 336 and 340. Beverage containers 343 that have been previously chilled may then be successively stacked into the chutes in side-by-side relationship for vending.

Alternatively, the vendor may remove the insulated fabric cover 319 and strap assembly 321 from the rack assembly 324 by removing the attaching hardware 360, load the dispensing chutes of the rack assembly with unchilled beverage containers 319 and place the loaded rack assembly 324 into a cooling vessel, e.g., a freezer, for quick chilling. After the beverage containers 343 have been chilled to a suitable temperature, the rack assembly 324 may be removed from the cooling vessel and the fabric cover 319 and strap assembly 321 reattached over the rack assembly. Under either method of loading, the fabric cover 319 act to insulate and maintain the chilled temperature of the beverage containers stored therein and also act to protect the vendor wearing the dispenser 310 from the cold temperature of the chilled rack assembly 320 during vending. Moreover, because the fabric cover 319 and strap assembly 321 are removable from the rack assembly 324, cleaning of the rack assembly, cover and strap assembly is made simple.

Referring now to FIGS. 12 through 16, there is shown at 410 the preferred embodiment of the dispenser constructed in accordance with this invention. Like the dispensers described in the earlier embodiments, this preferred dispenser 410 is arranged for dispensing a variety of differently sized and shaped beverage containers, e.g., cans or bottles, containing both carbonated and noncarbonated beverages such as soda, beer, ice tea, chocolate milk, etc. The dispenser 410 includes a housing formed of a storage portion 412 and a door portion 423 pivotally mounted to the storage portion 412 by hinges (not shown) to enable the door to swing between an open position to enable the vendor to load a rack assembly 420 located therein with beverage containers and a closed position during vending. The storage portion 412 and door portion 423 are similar in construction and operation to the storage and door portion described in the embodiment shown in FIGS. 1 through 6.

Figure 13:
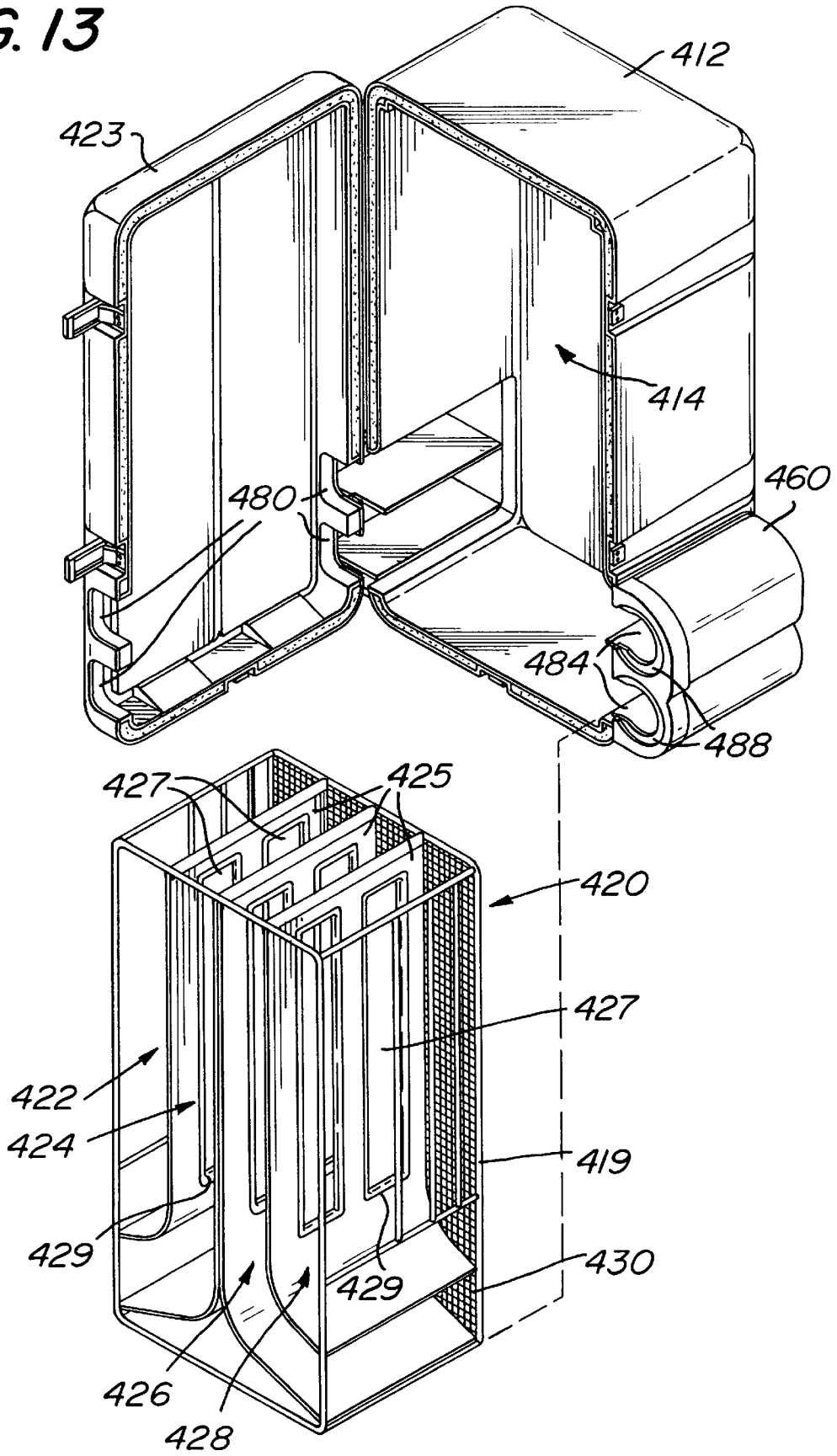
FIG. 13 is an isometric view of the preferred embodiment shown in FIG. 1 with the door of the housing placed in the open position and the rack assembly removed therefrom.

As best shown in FIG. 13, the storage portion 412 and the door portion 423 form a thermally insulated internal compartment 414 within the dispenser 410 to maintain the chilled temperature of beverage containers stored within the dispenser. It should be understood that in accordance with this invention, the dispenser 410 is equally suited for the dispensing of bottles and cans. The internal compartment is of a predetermined depth that is suitable for receiving and containing a removable rack assembly 420 therein. The rack assembly 420 is arranged for retaining beverage containers e.g., bottles or cans, stacked in side-by-side relationship for dispensing. As best shown in FIG. 13, the rack assembly 420 is arranged to be removable from the internal compartment 414.

The rack assembly 420 is rectangular and box-like in shape and comprises a plurality of dispensing chutes, 422, 424, 426 and 428 which are arranged to retain the beverage containers 23 therein in a side-by side, single-file relationship and present them successively to one of a plurality dispensing ports located at the lower end of the storage portion 412 to enable removal of the beverage containers by the vendor wearing the dispenser 410. Each chute is suitably sized to allow the free movement of beverage containers, e.g., bottles or cans, stacked therein.

Figure 14:
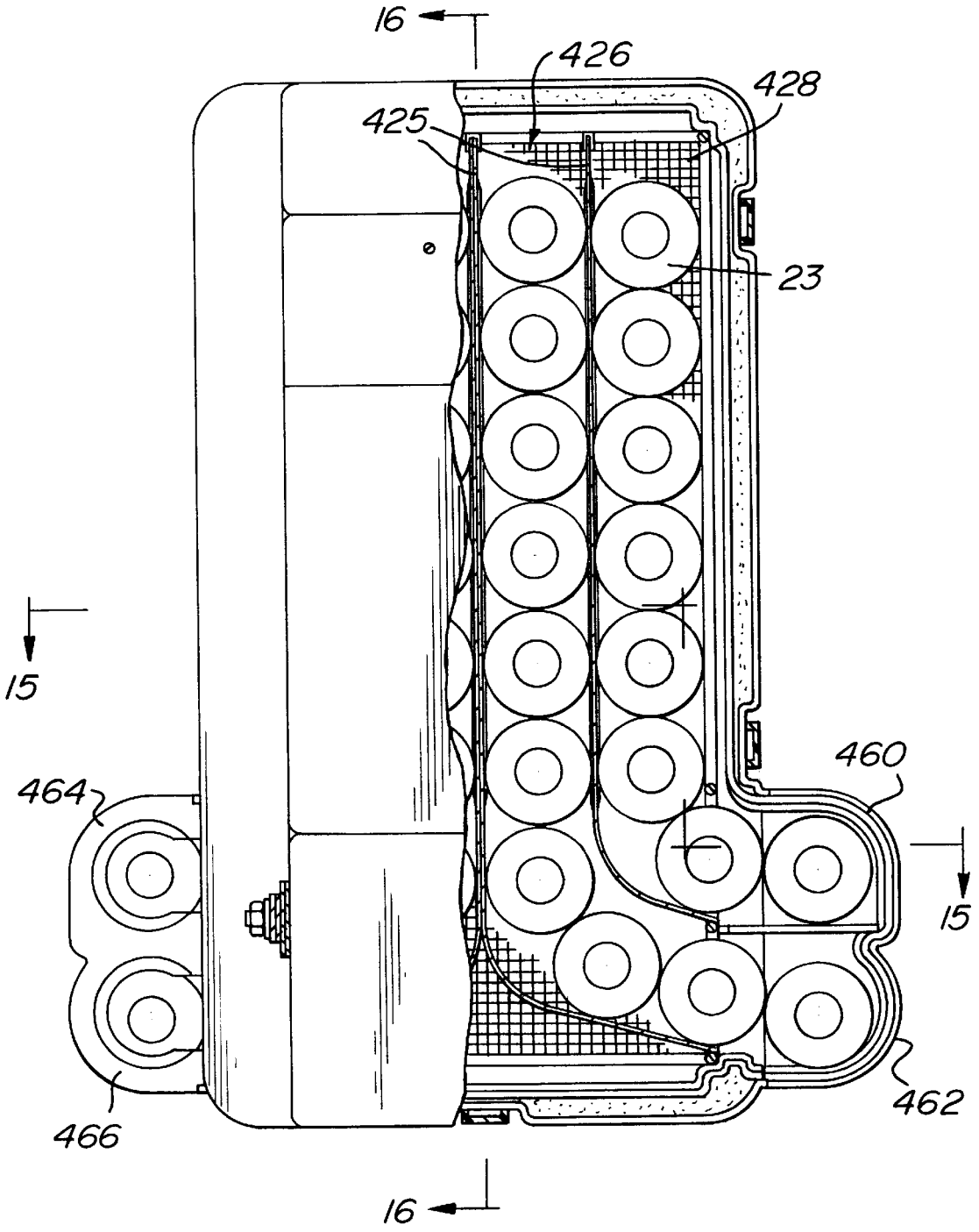
FIG. 14 is a front view of the preferred embodiment of the portable dispenser of the present invention, partially in section.

As best shown in FIGS. 13 and 14, the rack assembly 420 comprises a box-shaped wire frame assembly 419 formed of any suitable material, e.g., stainless steel, that is divided by a plurality, e.g., four, dividers 425. The dividers divide the rack assembly into a plurality, e.g., four, dispensing chutes 422, 424, 426 and 428. Referring again to FIGS. 13 and 14, each chute extends downwardly until it reaches an inclined ramp portion. The ramp portion of each chute is provided to direct beverage containers 23 stacked within each chute towards an outlet end located at the bottom of each chute. Each divider is formed of any suitable material, e.g., aluminum, and includes elongated rectangular openings 427 which reduces material requirements during fabrication and also allows for the passage of chilled air through the chutes to maintain the low temperature of the beverage containers stored therein. Dressed over the edges of the dividers forming each elongated opening are plastic guards 429 to protect the vendor from laceration injury to fingers and hands during the loading of containers into the dispenser 410. The rack assembly 420 is also provided with a mesh back wall 430 formed of any suitable material, e.g., stainless steel and a floor 431.

By removing the rack assembly 420 from the storage portion 412, and placing it against its backwall 430, the vendor may load the rack assembly. In particular, the vendor may place bottles or cans 23 through the open front end of each chute in side-by-side, single-file relationship one next to the another in the arrangement shown in FIG. 14. Once the rack assembly is loaded, it is placed in a cooling vessel, e.g., a freezer, for quick chilling. After the beverage containers 23 have been chilled to a suitable temperature, the rack assembly 420 may be removed from the cooling vessel and reinserted into the storage portion 412. In particular, the rack assembly is first uprighted and then replaced into the storage portion 412. The vendor may place cardboard inserts (not shown) or other suitable blocking means just inside the outlet ends located at the bottom of each chute 422, 424, 426 and 428 to prevent beverage containers loaded within the rack assembly from falling through the outlet ends of the rack assembly during uprighting of the rack assembly 420. Once the rack assembly is loaded into the housing 412, the door portion 423 may be closed and secured in the closed position to provide an airtight seal by use of clasping components as described in connection with the embodiment shown in FIGS. 1 through 6. Since the storage portion 412 is thermally insulated but has not been chilled, it will act to protect the vendor wearing the dispenser 410 from the cold temperature of the chilled rack assembly 420 while acting to insulate and maintain the chilled temperature of the beverage containers stored therein.

The outlet end of each chute communicates with one of a plurality of dispensing ports, 460, 462, 464 and 466. Dispensing ports 460 and 462 are adjacent one side of the storage portion 412, the former located above the latter, while dispensing ports 464 and 466 are adjacent the opposite side of the storage portion 412, the former located above the latter.

As best shown in FIGS. 13 and 14, the door portion 423 is provided with cutout sections 480 that correspond with the outlet end of each chute. The cutout sections 480 are provided to enable passage of bottles 23 from the outlet end of each chute to the corresponding dispensing port.

As described in the embodiment shown in FIGS. 1 through 6, each dispensing port is provided with a circular opening 484 on its front face that is slightly larger than the exterior dimensions of the beverage container 23 disposed therein. The circular opening 484 is provided to permit the passage of beverage containers 23 therethrough, one at a time, during vending. Each dispensing port 484 is provided with a neoprene cap 488 disposed over the circular opening 484 slightly smaller in diameter than the outer dimension of the beverage container 23 extending therethrough.

Figure 15:
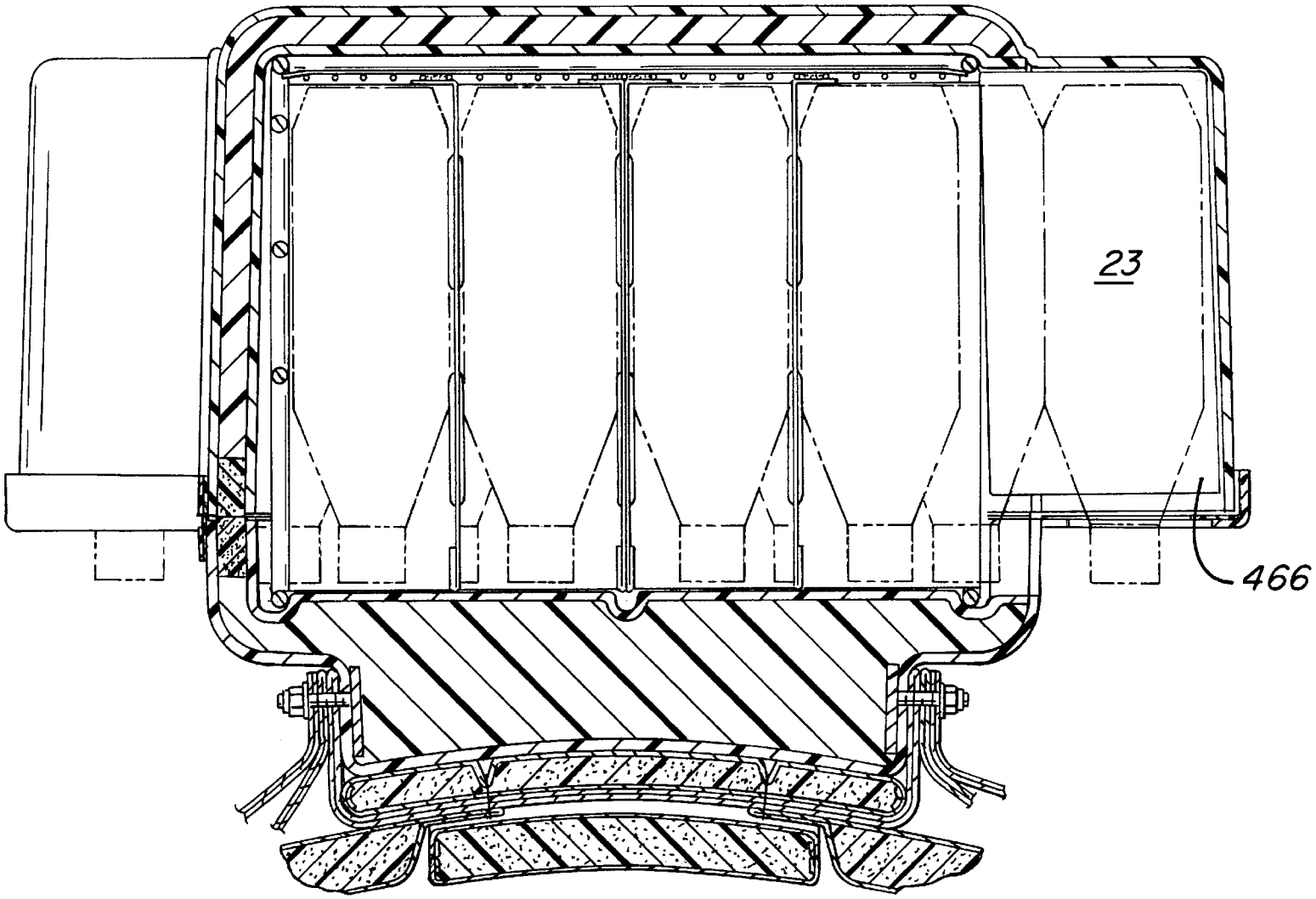
FIG. 15 is a sectional view taken along line 15—15 of FIG. 14.
Figure 16:
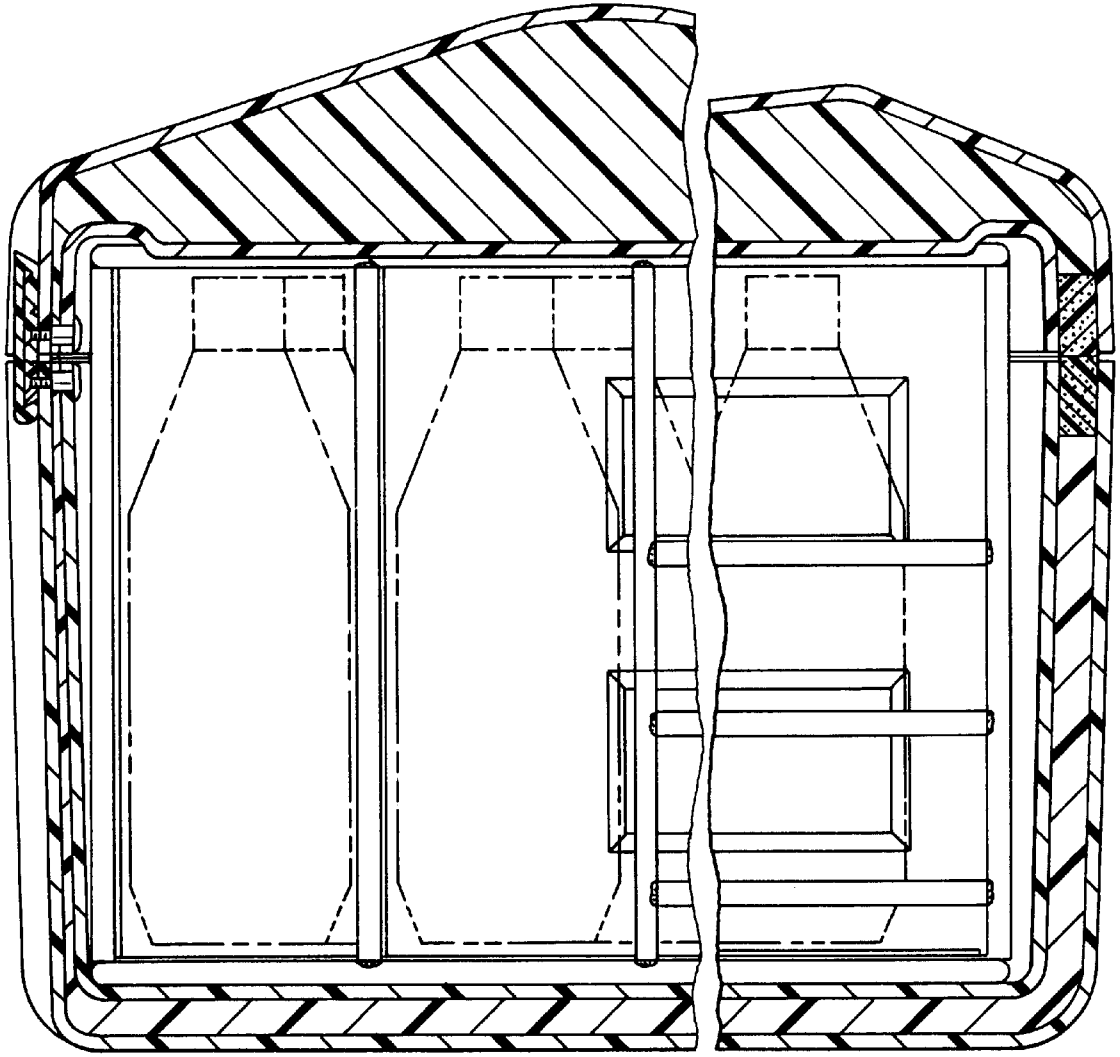
FIG. 16 is a sectional view taken along line 16—16 of FIG. 14.

As best explained in connection with the earlier described embodiment shown in FIGS. 1 through 6, as shown in FIG. 15, the depth of each dispensing port 466 is actually shorter than the length of a bottle contained the rein. In this manner, the dispensing port is sized to permit the neck and cap of a bottle 23 to protrude beyond the port opening so that the neck engages the inner surface of the neoprene cap 240. This engagement acts to restrict the entry of warm air into the interior chamber during vending.

As shown in FIG. 15, the dispenser 410 is provided with a strap assembly 490 for supporting the dispenser 10 on the back of a vendor. This preferred embodiment 410 comprises a strap assembly similar in construction and operation to that described in connection with the previously described embodiment shown in FIGS. 1 through 6. The vendor dispenses beverage containers while wearing the dispenser 410 on his back in a manner similar to that described in connection with the previously described embodiment shown in FIGS. 1 through 6.

Figure 17:
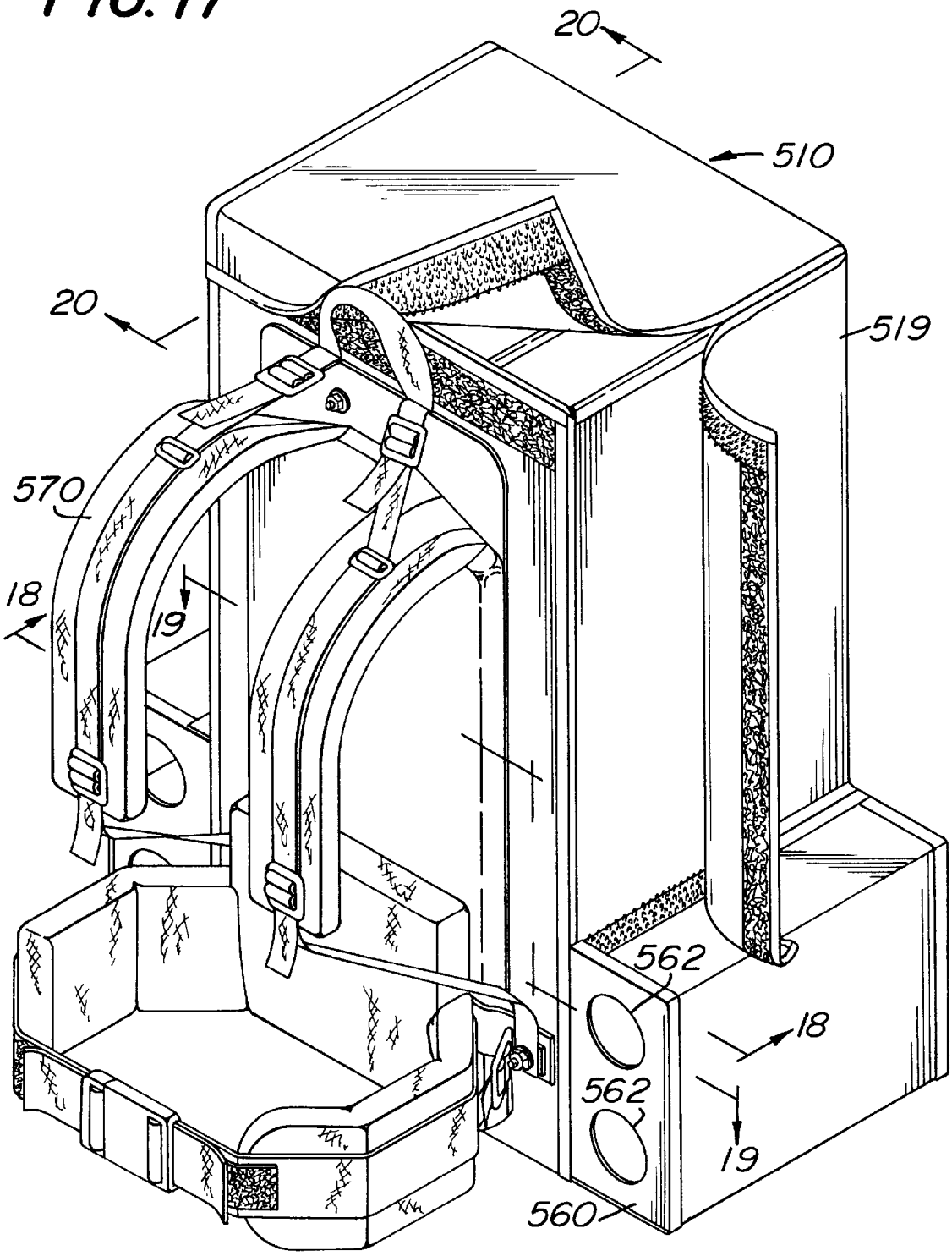
FIG. 17 is an isometric view of a second preferred embodiment of the dispenser of the present invention.
Figure 18:
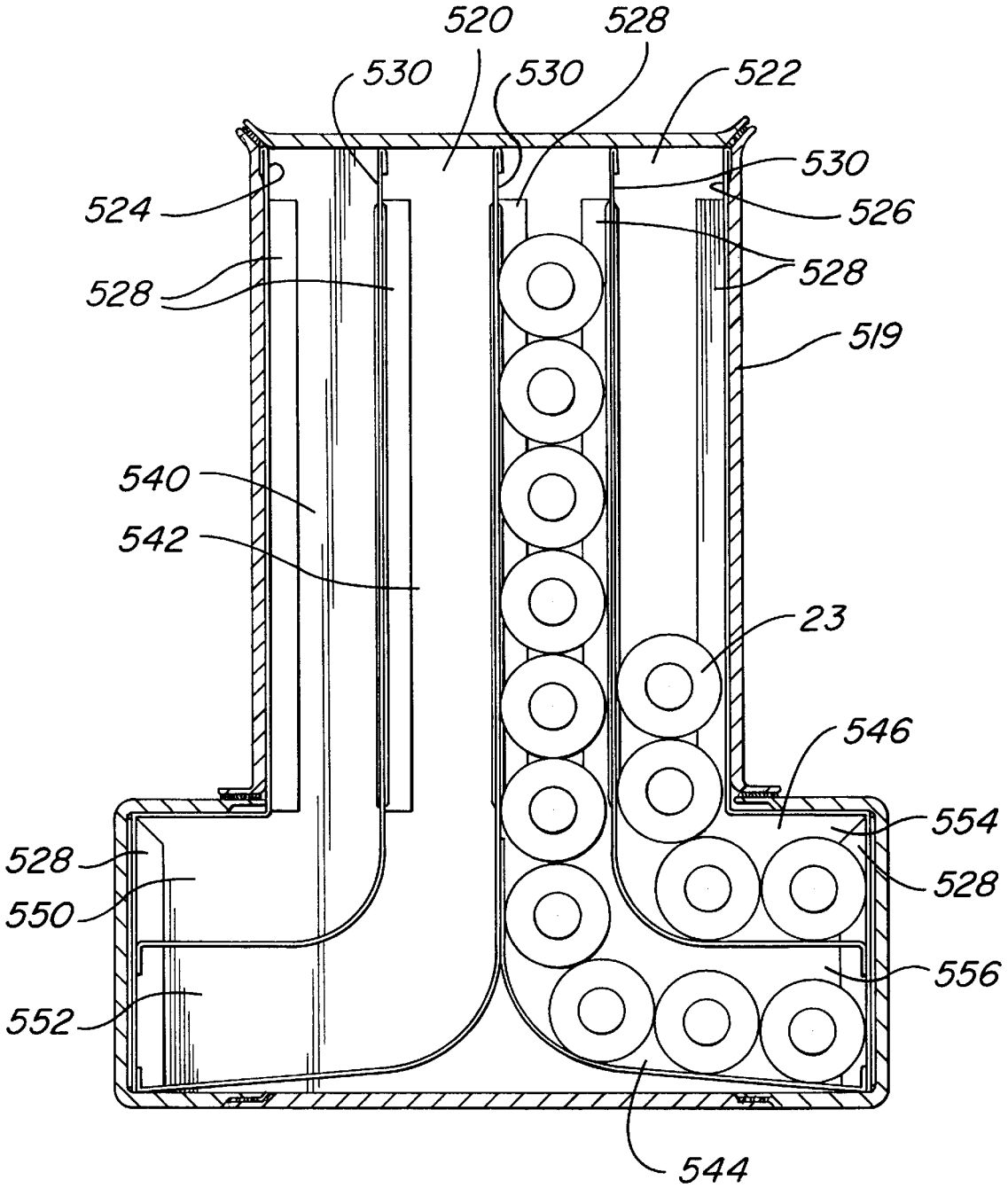
FIG. 18 is a sectional view taken along line 18—18 of FIG. 17.

Referring now to FIGS. 17 through 21, there is shown at 510 a second preferred embodiment of the dispenser constructed in accordance with this invention. Basically, the second preferred embodiment 510 also comprises an insulated fabric cover 519 that surrounds a rack assembly 520. As best shown in FIG. 18, the rack assembly 520 generally resembles the shape of an inverted letter "t" and comprises a solid backwall 522 and solid sidewalls 524 and 526. Sidewalls 524 and 526 are provided with flanges 528 to enable attachment of the sidewalls to the backwall by any suitable means, e.g., conventional hardware such as rivets or welding.

Figure 20:
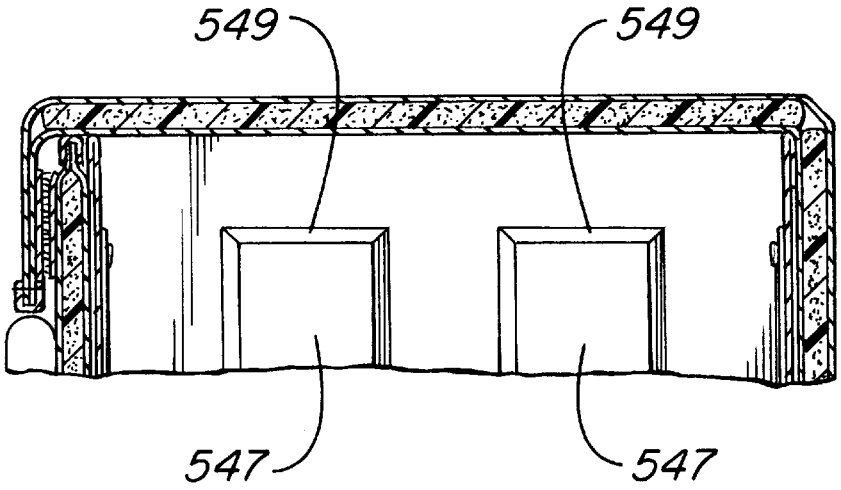
FIG. 20 is a sectional view taken along line 20—20 of FIG. 17.
Figure 21:
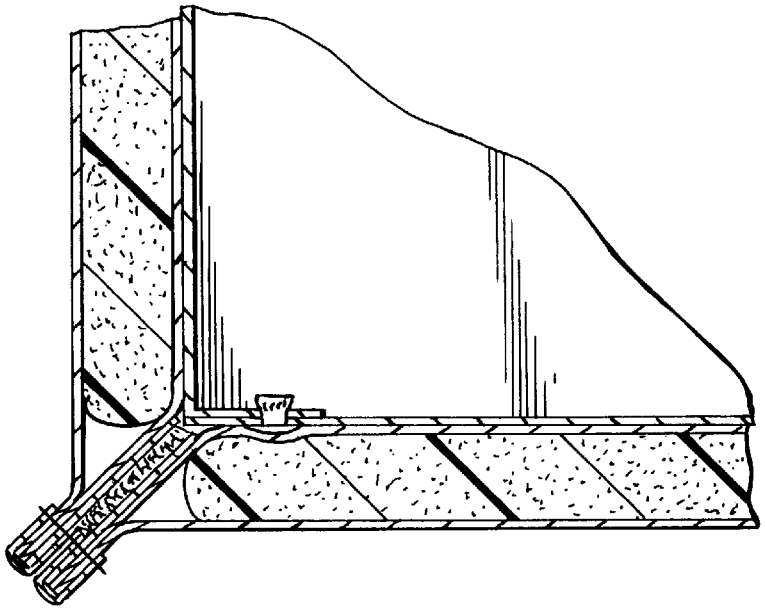
FIG. 21 is a detail view of a corner of FIG. 18.

The rack assembly 520 is provided with a plurality of dividers 530, e.g., four, that are provided with flanges 528 to enable attachment of the dividers 530 to the backwall 522 and sidewalls 524 and 526. The dividers 530 define a plurality of dispensing chutes, 540, 542, 544 and 546. Each divider is formed of any suitable material, e.g., aluminum, and as best shown in FIG. 20 includes elongated rectangular openings 547 which act to reduce material requirements during fabrication and also allow for the passage of chilled air therethrough to maintain the low temperature of the beverage containers stored therein. Also as shown in FIG.

20, dressed over the edges of the dividers forming each elongated opening are plastic guards 549 to protect the vendor from laceration injury to fingers and hands during the loading of containers into the dispenser 510.

As best shown in FIG. 18, each dispensing chute is arranged to receive a plurality of beverage containers 23 therein, retain the beverage containers in a side-by-side, single-file relationship and present them successively to one of a plurality of dispensing ports 550, 552, 554 and 556.

Referring to FIG. 18, dispensing ports 550 and 552 are located at one side of the rack assembly 520, the former located above the latter, while dispensing ports 544 and 556 are located at the other side of the rack assembly 520, the former located above the latter. Each dispensing port is constructed in a manner to permit withdrawal of beverage containers 23 only through the front end thereof during vending. As best shown in FIG. 18, each chute extends downwardly from the top of the rack assembly 520 and ramps towards a dispensing port. Each divider 530 is continuous as it extends downwardly, then curves and runs horizontally into the port.

Figure 19:
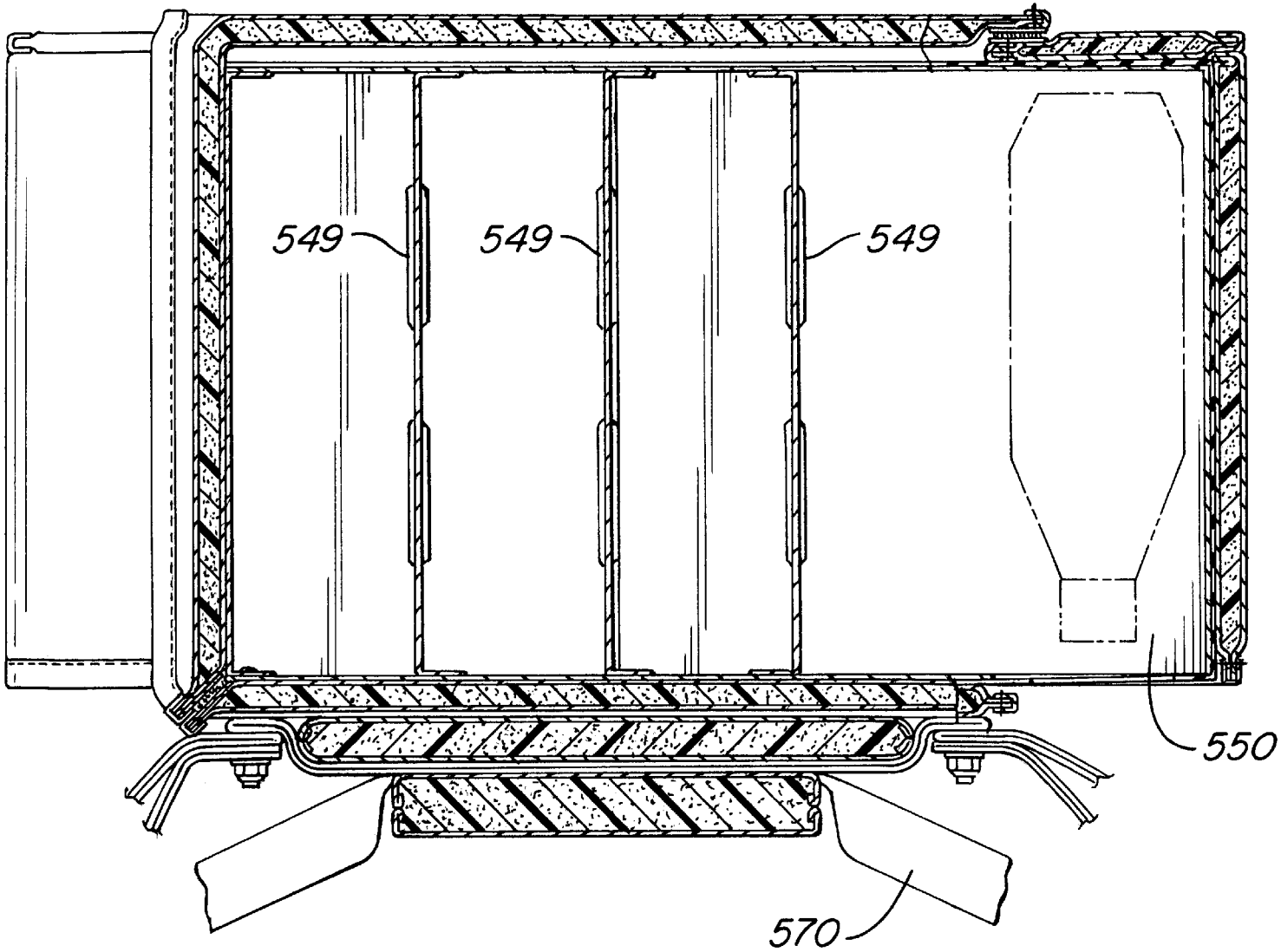
FIG. 19 is a sectional view taken along line 19—19 of FIG. 17.

Referring again to FIG. 17, a neoprene liner 560 located under the insulated fabric cover 519 surrounds the dispensing ports. The neoprene liner comprises a plurality of circular openings 562, each centered over the open end of each dispensing port. Each circular opening 562 is slightly larger than the exterior dimensions of the beverage container to permit the passage of beverage containers 23 therethrough one at a time during vending. The neoprene liner also acts to restrict the entry of warm air into the dispensing ports and the compartment during vending. This preferred embodiment 510 comprises a strap assembly 570 similar in construction and operation to that previously described and shown in FIG. 7. As best shown in FIGS. 17 and 19 the strap assembly 570 is removably secured to the rack assembly 520 by means of conventional hardware, e.g., nuts and bolts.

Referring again to FIGS. 17, 18 and 21, the insulated fabric cover 519 attaches to the rack assembly by means of conventional hardware, e.g., nuts, bolts and washers. The fabric cover 519 is similar in construction and operation to the fabric cover 319 previously described and shown in FIGS. 7 through 11 in that it is removable from the rack assembly for cleaning and to facilitate loading of beverage containers.

This embodiment 510 is loaded in a manner similar to that previously described in connection with the embodiment 310. That is, the vendor simply removes the top panel of the fabric cover 519 to gain access to dispensing chutes 540, 542, 544 and 546. Beverage containers 23 that have been previously chilled may then be successively stacked into the chutes in side-by-side relationship for vending.

Alternatively, the vendor may remove the insulated fabric cover 519 and strap assembly 570 from the rack assembly 524, load the dispensing chutes of the rack assembly with unchilled beverage containers 23 and place the loaded rack assembly 524 into a cooling vessel, e.g., a freezer, for quick chilling. After the beverage containers 23 have been chilled to a suitable temperature, the rack assembly 524 may be removed from the cooling vessel and the fabric cover 519 and strap assembly 570 reattached over the rack assembly 524. Under either method of loading, the fabric cover 519 acts to insulate and maintain the chilled temperature of the beverage containers stored therein and also acts to protect the vendor wearing the dispenser 510 from the cold temperature of the chilled rack assembly 524 during vending.

Without further elaboration the foregoing will so fully illustrate my invention that others may, by applying current or future knowledge, adapt the same for use under various conditions of service.

I claim:

1. A portable dispenser for beverage containers for use by a vendor, said dispenser comprising:

a. a housing;

b. a strap assembly secured to said housing to enable said dispenser to be worn like a backpack to enable hands-free use during vending;

c. a chamber located within said housing;

d. a rack disposed within said chamber said rack comprising at least one dispensing chute, said at least one dispensing chute permitting the insertion of a plurality of beverage containers therein and comprising a length for retaining the beverage containers in single-file relationship therein, said at least one dispensing chute further comprising an outlet end, said dispensing chute being arranged to present a successive beverage container to said outlet end upon the removal of a preceding beverage container therefrom, said housing comprising a fabric cover surrounding said rack, said fabric cover being removable therefrom; and, e. said dispenser additionally comprising at least one dispensing port, said dispensing port being in communication with the outlet end of said dispensing chute to enable the vendor to remove beverage containers from said dispenser.

2. The portable dispenser of claim 1 wherein said fabric cover comprises a jacket portion formed of a top panel, a plurality of side panels, a front panel, a rear panel and a bottom panel, said panels being provided with cooperating hook and loop components to enable fastening of said panels together.

3. The portable dispenser of claim 2 wherein said jacket portion is formed of nylon.

4. The portable dispenser of claim 3 wherein said fabric cover additionally comprises a plurality of insulation members, each panel of said jacket portion surrounding an insulation member.

5. The portable dispenser of claim 3 wherein each insulation member is formed of a neoprene foam insert.

6. The portable dispenser of claim 1 wherein said at least one dispensing chute comprises two adjacent dispensing chutes, said chutes being separated by a dividing means.

7. The portable dispenser of claim 6 wherein said dividing means is formed of aluminum.

8. The portable dispenser of claim 7 wherein said dividing means additionally comprises a central opening, said dispenser additionally comprising a guard dressed over said opening to protect against laceration injury to fingers and hands during loading of beverage containers into the dispenser.

9. The portable dispenser of claim 1 wherein said fabric cover is insulated.

10. The portable dispenser of claim 1 wherein the beverage containers are cylindrical cans.

11. The portable dispenser of claim 1 wherein the beverage containers are bottles.

12. The portable dispenser of claim 1 wherein said housing comprises a storage portion and a door portion pivotally mounted to said storage portion.

13. The portable dispenser of claim 1 wherein said receiving end is located above said outlet end of said delivery chute and wherein said intermediate length comprises an upper portion and a lower ramp portion, said upper portion extending substantially vertically downwardly from said receiving end, said lower ramp portion extending from the lower end of said upper portion to said outlet end.

14. The portable dispenser of claim 1 wherein said rack comprises a rectangular box-shaped cage.

15. The portable dispenser of claim 1 wherein said rack is formed of aluminum.

16. The portable dispenser of claim 1 wherein said at least one dispensing port is located on opposed sides of said rack.

17. The portable dispenser of claim 1 wherein said dispenser additionally comprises a closure disposed over each of said dispensing ports to minimize entry of warm air into said insulated chamber.

18. The portable dispenser of claim 17 wherein said closure comprises a neoprene cap.

19. The portable dispenser of claim 1 wherein said strap assembly comprises a plurality of shoulder straps and a waist strap.

20. The portable dispenser of claim 1 wherein said strap assembly additionally comprises padding located adjacent said housing.

21. The portable dispenser of claim 1 wherein said rack is removable from said chamber.

22. The portable dispenser of claim 1 wherein said housing comprises an outer wall, an intermediate insulated core and an inner wall.

23. A portable dispenser for beverage containers for use by a vendor, said dispenser comprising:

a. a housing comprising;

b. a strap assembly secured to said housing to enable said dispenser to be worn like a backpack to enable hands-free use during vending;

c. a chamber located within said housing;

d. a rack disposed within said chamber, said rack comprising a first dispensing chute and a second dispensing chute adjacent said first dispensing chute, each said dispensing chute permitting the insertion of a plurality of beverage containers therein and comprising a length for retaining the beverage containers in single-file relationship therein, each said dispensing chute further comprising an outlet end, each said dispensing chute being arranged to present a successive beverage container to said outlet end upon the removal of a preceding beverage container therefrom, the outlet end of said first dispensing chute being located above the outlet end of said second dispensing chute to enable dispensing of more than one type of beverage simultaneously; and, e. said dispenser additionally comprising a dispensing port in communication with the outlet end of each said dispensing chute to enable the vendor to remove beverage containers from said dispenser.

24. The portable dispenser of claim 23 wherein said at least one dispensing chute additionally comprises a third dispensing chute and a fourth dispensing chute, each of said third and fourth dispensing chutes having an outlet end and said third dispensing chute being adjacent said fourth dispensing chute, the outlet end of said third dispensing chute being located above the outlet end of said fourth dispensing chute.

25. The portable dispenser of claim 24 wherein said at least one dispensing port additionally comprises a third dispensing port in communication with the outlet end of said third dispensing chute and a fourth dispensing port in communication with the outlet end of said fourth dispensing chute, said third and fourth dispensing ports being located opposite said first side of said rack means.

26. The portable dispenser of claim 23 wherein said at least one dispensing port comprises a first dispensing port in communication with the outlet end of said first dispensing chute and a second dispensing port in communication with the outlet end of said second dispensing chute, said first and second dispensing ports being located adjacent a first side of said rack means.

* * * * *